United States Patent [19]

Champagne et al.

[11] Patent Number: 4,915,906

[45] Date of Patent: Apr. 10, 1990

[54] NOVEL ZINC-BASED ALLOYS, PREPARATION AND USE THEREOF FOR PRODUCING THERMAL-SPRAYED COATINGS HAVING IMPROVED CORROSION RESISTANCE AND ADHERENCE

[75] Inventors: Blaise Champagne; Bernard Arsenault, both of Boucherville; Claude Gelinas, Ste.Etienne Lauzon; Serge Dallaire, Longueuil, all of Canada

[73] Assignee: Canadian Patents and Development Limited/Societie Canadienne des Brevets et d'Exploitation Limitee, Ottawa, Canada

[21] Appl. No.: 207,942

[22] Filed: Jun. 17, 1988

[51] Int. Cl.[4] ..... C22C 18/00; C22C 19/03

[52] U.S. Cl. ..... 420/441; 420/513; 427/422

[58] Field of Search ..... 420/513, 590, 441; 427/422, 423; 75/251; 428/659, 937

[56] References Cited

U.S. PATENT DOCUMENTS

| | | | |
|---|---|---|---|
| 3,201,212 | 8/1965 | Zaremski | 428/937 |
| 3,598,383 | 10/1971 | Moore | 420/590 |
| 3,791,801 | 2/1974 | Ariga et al. | 428/659 |
| 3,801,355 | 4/1974 | Cakenberghe | 204/164 |
| 4,252,866 | 2/1981 | Matsudo et al. | 420/513 |
| 4,302,483 | 11/1981 | Altorfer et al. | 427/422 |
| 4,510,209 | 4/1985 | Hada et al. | 428/659 |
| 4,526,618 | 7/1985 | Keshavan et al. | 106/1.05 |
| 4,610,937 | 9/1986 | Ito et al. | 420/513 |
| 4,629,659 | 12/1986 | Kyono et al. | 428/659 |
| 4,640,872 | 2/1987 | Irie et al. | 420/513 |
| 4,659,631 | 4/1987 | Kurimoto et al. | 428/659 |
| 4,707,415 | 11/1987 | Ikeda et al. | 428/659 |

FOREIGN PATENT DOCUMENTS

| | | | |
|---|---|---|---|
| 174019 | 3/1986 | European Pat. Off. | 428/659 |
| 199805 | 11/1983 | Japan | 420/513 |
| 162293 | 9/1984 | Japan | 428/659 |
| 50195 | 3/1985 | Japan | 428/659 |
| 138093 | 7/1985 | Japan | 428/659 |
| 4086 | of 1888 | United Kingdom | 420/513 |

*Primary Examiner*—Robert McDowell

*Attorney, Agent, or Firm*—Swabey, Mitchell, Houle, Marcoux & Sher

[57] ABSTRACT

A zinc-based alloy comprising about 50 to 90 weight percent zinc and about 10 to 50 weight percent of at least one other metal selected from the group consisting of nickel, cobalt and iron. The zinc-based alloy according to the invention is particularly suitable for use as coating material for producing thermal-sprayed coatings having improved corrosion resistance and adherence.

18 Claims, No Drawings

NOVEL ZINC-BASED ALLOYS, PREPARATION AND USE THEREOF FOR PRODUCING THERMAL-SPRAYED COATINGS HAVING IMPROVED CORROSION RESISTANCE AND ADHERENCE

BACKGROUND OF THE INVENTION

The present invention relates to novel zinc-based alloys as well as to the preparation and use thereof for producing thermal-sprayed coatings having improved corrosion resistance and adherence.

Thermal-spraying is a generic term designating a type of method according to which molten or semi-molten particles are propelled and allowed to strike a surface in a uniform manner to form a coating. Examples of such methods include flame-spraying and plasma-spraying as well as the so-called detonation gun process and jet coat process, which are all well known in the art.

Thermal spraying allows the production of coatings of a wide variety of materials provided that the coating material does not sublimate, decompose or excessively vaporize during thermal spraying. Metals, alloys, ceramics and polymers can thus be sprayed on almost any substrates such metals, plastics, wood, ceramics and composites. Thermal-sprayed coatings are used in many industrial applications to protect parts against degradation such as that caused by corrosion in a gas or liquid at ambient or elevated temperature, or wear by a gas, liquid or solid in an aggressive environment at ambient or elevated temperature. Thermal-sprayed coatings are also used for producing unique operating mechanical systems such as thermal barrier coatings or clearance control abradable seals for jet-engines, for reclamation of worn parts by spraying material where volume losses have occurred, for lubrication at high temperature and for producing various coatings having special purposes in the electronic, printing, drilling, atomic, aeronautic, mining and chemical industries.

Thermal-sprayed coatings can comprise only one layer of material or a plurality of layers of different materials. In the case of multi-layered coatings, the layer on the substrate is generally designated as a bond coat since most of the time its function is to serve as anchorage for other types of material; on the other hand, the last layer to be deposited is generally referred to as top coat. Bond coats have been developed to significantly increase performance and reliability of coating systems. On an historical basis, the development of bond coat materials have evolved from molybdenum in the early 1940's, to nickel-chromium alloys in the 1950's, to nickel-aluminum composites in the 1960's, to aluminium bronze in the 1970's, and to pre-alloyed nickel aluminium. All these bond coat materials have been primarily developed to increase the adherence of coatings and in some cases to provide at the same time a good oxidation resistance, and they are thus not suitable for protecting parts against aqueous corrosion in humid environment as found in outdoor structures. In this later case, coatings based on zinc, aluminium or their alloys have been particularly studied and have been extensively utilized. Thermal-sprayed aluminium coatings have been developed for U.S. Navy ships for corrosion control. These aluminum-based coatings present important drawbacks since they ave a residual porosity which is detrimental. Very effective organic sealer must be used to impede the penetration of water when such aluminium-based coatings are used. Moreover, these coatings cannot be used as a bond coat due to the presence of an organic sealer. Thermal-sprayed coatings have also been used for protection of outdoor structures in a wide range of environment. Zinc and zinc-aluminum alloys have been particularly successful in protecting large structures such as bridges in many countries. In this case, the coating is only used for aesthetic and corrosion control purposes. The adherence of these coatings is relatively low and they are thus unsuitable for use as bond coat.

SUMMARY OF THE INVENTION

It is therefore an object of the present invention to overcome the above drawbacks and to provide a coating material suitable for producing thermal-sprayed coatings having improved corrosion resistance and adherence, thus enabling such coatings to be used as a bond coat as well as a top coat.

According to one aspect of the invention, there is provided a novel zinc-based alloy comprising about 50 to 90 weight percent zinc and about 10 to 50 weight percent of at least one other metal selected from the group consisting of nickel, cobalt and iron.

It has been surprisingly found that thermal-sprayed coatings made of the above zinc-based alloy exhibit improved resistance to aqueous corrosion and are thus suitable for use as a top coat for protecting metallic parts against aqueous corrosion. These coatings are also particularly useful as a bond coat since they provide improved adherence and impede spalling of the top coat normally observed with existing bond coats in aqueous corrosion conditions. Corrosion potential measurements made on the zinc-based alloys of the invention confirmed the propensity and the capability of such alloys to form a galvanic cell providing an active cathodic protection to steel. This cathodic protection against corrosion is not affected by the presence of residual porosity so that no sealer is necessary to seal any residual porosity in order to effectively protect metallic parts against corrosion in humid environment.

The high vapor pressure of metallic zinc above its melting point normally leads to low density thermal-sprayed coatings with poor adherence and also to difficulties in injecting zinc powder due to sticking problems. It has surprisingly been found that the novel zinc-based alloys according to the invention can be thermal-sprayed without excessive zinc vaporization and without sticking problems. The unexpected decrease in vapor pressure of the alloys according to the invention as well as their higher melting point contribute to this different behavior during thermal-spraying and enable the production of thermal-sprayed coatings with superior adherence and high density. It has been discovered that a zinc-based alloy is absolutely necessary for observing such results as opposed to a powder constituted of composite particles made up from an agglomeration or a mechanical mixture of metallic elements. This result is particularly unforeseen since it would normally be expected that composite particles should melt and transform into alloyed particles when being subjected to thermal-spraying. This is not the case since, when the powder is not alloyed, there are two metallic elements with different melting points and the big difference in melting temperature causes the zinc to vaporize before the second element (i.e. nickel, cobalt or iron) has melted. Thus, since the melting temperature of the second element is well above the boiling temperature of zinc, excessive zinc vaporization occurs.

Accordingly, the present invention provides, in another aspect thereof, a coating material for forming corrosion-resistant thermal-sprayed coatings on metallic substrates, comprising a zinc-based alloy as defined above, in the form of particles having a size ranging from about 0.03 to about 0.15 mm.

The present invention also provides, in a further aspect thereof, a method of applying by thermal spraying a coating material onto a metallic substrate to form a corrosion-resistant coating, wherein use is made of a coating material as defined immediately above.

In order to be suitable for thermal spraying, the zinc-based alloys according to the invention must be transformed into powders with a particle size ranging from about 0.03 to about 0.15 mm. It has been observed in this respect that alloy particles having a size less than 0.03 mm are too readily vaporizable and thus vaporize before larger particles have undergone melting; the use of particles smaller than 0.03 mm should therefore be avoided. On the other hand, particles with a size greater than 0.15 mm require a very high energy transfer rate during thermal spraying for complete melting. This results in a disintegration of the particles into smaller particles which are then excessively vaporized. As alloy particles are seldom spherical, such a high energy transfer rate is very detrimental since causing the generation of larger temperature gradients within a same particle having a different geometrical configuration. This results again in excessive vaporization which is very detrimental to the thermal spraying process. In addition to presenting problems of obstructing the feeding means, particles with a size greater than 0.15 mm are also difficult to transport and require large amounts of powder carrier gases.

The novel zinc-based alloy of the invention is prepared, according to yet another aspect of the invention, by a process comprising the steps of heating together about 50 to 90 weight percent zinc and about 10 to 50 weight percent of at least one other metal selected from the group consisting of nickel, cobalt and iron, at a temperature above the melting point of the alloy, under an inert gas atmosphere at a pressure above vapor pressure of zinc at the said temperature, to cause melting of the zinc and solubilization of the other metal in the molten zinc while preventing zinc vaporization, and maintaining the zinc and the other metal at the said temperature over a period of time sufficient to ensure homogenization of the resulting alloy.

The zinc-based alloy thus obtained can thereafter be transformed into a powder of the desired particle size, by crushing or atomization depending upon the ductility of the alloy. For some ductile crystalline structures such as zinc-nickel alloys with more than 40% wt. % nickel, atomization is the only method by which powders can be prepared; in fact, it is not possible to use combination methods for the production of powders from these alloys.

DESCRIPTION OF PREFERRED EMBODIMENTS

In a preferred embodiment of the process for preparing the zinc-based alloys according to the invention, the zinc and the other metal, i.e. nickel, cobalt or iron, are heated at about 50°–250° C., preferably about 100°–150° C., above the melting point of the alloy for at least 30 minutes. The melting point of the zinc-based alloy can be determined from the phase diagrams of the metallic components.

The inert gas atmosphere in which the alloy is prepared is preferably maintained at a pressure of about 100 to 1000 KPa, so as to prevent zinc vaporization as well as zinc oxidation. Argon is preferably used as inert gas.

When preparing a zinc-nickel alloy, the zinc and nickel are preferably used in amounts of about 50 to 75 weight percent and about 25 to 50 weight percent, respectively. In the case of a zinc-cobalt alloy, the zinc and cobalt are preferably used in amounts of about 80 to 90 weight percent and about 10 to 20 weight percent, respectively. On the other hand, in the case of a zinc-iron alloy, the zinc and iron are preferably utilized in amounts of about 60 to 85 weight percent and about 15 to 40 weight percent, respectively.

After being allowed to cool to ambient temperature under the inert gas atmosphere, the zinc-based alloy can be transformed into a powder having a particle size of about 0.03 to 0.15 mm, preferably about 0.05 to 0.12 mm, so as to be suitable for thermal spraying.

The coating material according to the invention comprising zinc-based alloy particles is preferably applied onto a substrate by plasma-spraying. In this case, a plasma is first generated and the coating material is then admixed with the plasma to cause melting of the alloy particles and propelling of the molten alloy particles in a direction toward the substrate, the alloy particles having a residence time in the plasma which is controlled to cause melting of the alloy particles while preventing vaporization of zinc from the molten alloy particles. Thus, for example, where the plasma generated is a low-energy subsonic plasma, the residence time of the alloy particles in such a plasma should be about 0.5 ms. to prevent zinc vaporization while ensuring proper melting of the particles necessary for high adherence. Moreover, in order to optimize the efficiency of deposition, the distance which the molten alloy particles are allowed to travel prior to impact on the substrate should preferably be maintained between about 6 and 10 cm.

The thermal-sprayed coatings produced according to the invention generally have a thickness of about 0.075 to 0.5 mm, preferably about 0.15 to 0.25 mm, and can used as a bond coat as well as a top coat.

The following non-limiting examples further illustrate the invention.

EXAMPLE 1

A zinc-nickel alloy comprising 70 wt. % zinc and 30 wt. % nickel and having a melting point of 875° C. was prepared by charging a mixture of 70 wt. % zinc granules and 30 wt. % nickel pellets in a crucible and placing the crucible thus charged into a controlled atmosphere chamber. The chamber was first air evacuated with a mechanical pump and then filled with argon at a slight positive pressure of 300 KPa. The crucible was thereafter heated at a temperature of 1050° C. under argon for 30 minutes, to cause melting of the zinc and solubilization of the nickel in the molten zinc. After cooling to ambient temperature under argon, the ingot alloy was crushed to produce a powder having a particle size ranging from 0.05 to 0.09 mm.

EXAMPLE 2

A zinc-nickel alloy comprising 50 wt. % zinc and 50 wt. % nickel and having a melting point of 1200° C. was prepared according to the procedure of Example 1, by heating a crucible charged with a mixture of 50 wt. % zinc granules and 50 wt. % nickel granules at a temperature of 1250° C. under argon for 45 minutes. The ingot alloy was atomized to produce a powder having a particle size ranging from 0.075 to 0.125 mm.

EXAMPLE 3

The powdered zinc-nickel alloy prepared in Example 1 was plasma-sprayed onto steel substrates to form a coating 0.150 mm thick according to the following parameters:

Subsonic mode—External Injection. Plasmadyne plasma torch.

| | |
|---|---|
| Plasmadyne eletrodes: | Anode #145<br>Cathode #129<br>Gas Injector #130 |
| Current: | 150 A |
| Tension: | 52 Volts |
| Plasma-Arc Gas: | Helium 78 l/min.<br>Argon 20 l/min. |
| Stand off distance: | 7 cm |
| Powder Carrier Gas: | Argon 6 l/min. |

The adherence of the coatings obtained by the above method was determined according to the ASTM C-633 procedure and a bond strength in the range of 35 MPa was obtained.

EXAMPLE 4

The powdered zinc-nickel alloy prepared in Example 2 was plasma-sprayed onto steel substrates to form a coating 0.200 mm thick according to the following parameters:

Subsonic mode—Internal Injection. Bay-State plasma torch.

| | |
|---|---|
| Bay-State eletrodes: | Anode #901356<br>Cathode #902352-1 |
| Current: | 530 A |
| Tension: | 35 Volts |
| Plasma-Arc Gas: | Argon 64 l/min. |
| Stand off distance: | 7.6 cm |
| Powder Carrier Gas: | Helium 16 l/min. |

The adherence of the coatings obtained was determined according to the ASTM C-633 procedure and a bond strength in the range of 30 MPa was obtained.

EXAMPLE 5

An ingot alloy of 70 wt. % zinc and 30 wt. % nickel was prepared according to the procedure of Example 1. The ingot was crushed to produce a coarse powder having a particle size ranging from 0.09 to 0.15 mm. This powder is then plasma-sprayed onto steel substrates to form a coating 0.200 mm thick according to the following parameters:

Subsonic mode—Internal Injection. Bay-State plasma torch.

| | |
|---|---|
| Bay-State eletrodes: | Anode #901356<br>Cathode #902352-1 |
| Current: | 450 A |
| Tension: | 33 Volts |
| Plasma-Arc Gas: | Argon 64 l/min. |
| Stand off distance: | 7.6 cm |
| Powder Carrier Gas: | Helium 16 l/min. |

The adherence of the coatings made with coarse powder was measured by ASTM C-633 and a bond strength of 40 MPa was obtained.

EXAMPLE 6

Plasma-sprayed coatings consisting of a zinc-nickel alloy comprising 70 wt. % zinc and 30 wt. % nickel were prepared according to the procedure of Example 3. A top coat, 0.200 mm thick, of a wear resistant chromium oxide ($Cr_2O_3$) was plasma-sprayed onto this zinc-nickel coating. Moreover, chromium oxide coating was plasma-sprayed directly onto steel substrates without a zinc-nickel bond coat. These two types of coating were tested for corrosion performance according to the B-117-85 ASTM procedure. After 1000 hours of corrosion exposure, the adherence of coatings was measured. Results indicated that the adherence of chromium oxide coatings without a 70–30 zinc-nickel bond coat was practically reduced to nothing (1 MPa). On the other hand, the initial adherence of chromium oxide coatings with an under layer of 70–30 wt. % zinc-nickel alloy was maintained.

EXAMPLE 7

Plasma-sprayed alumina coatings with and without a 70–30 wt. % zinc-nickel alloy were prepared according to procedure of Example 4. The adherence of these coatings was measured after 1000 hours of corrosion in a salt-spray test (ASTM B-117-85). It was observed that the adherence of alumina coatings without a zinc-nickel bond coat was reduced to a negligible value (spalling conditions) whereas the adherence of alumina coatings with a zinc-nickel underlayer was maintained.

EXAMPLE 8

A zinc-nickel alloy comprising 90 wt. % zinc and 10 wt. % nickel and having a melting point of 790° C. was melted in air. Powder was prepared from the alloy melt by atomization with nitrogen, thus obtaining particles having a size ranging from 0.04 to 0.09 mm. This powder was then plasma-sprayed onto steel substrates to form 0.25 mm thick coatings. These coatings were tested for 600 hours in a salt spray test according to the B-117-85 ASTM procedure. The adherence of the coatings was maintained to its original value (before exposure).

EXAMPLE 9

A zinc-cobalt alloy comprising 90 wt. % zinc and 10 wt. % cobalt and having a melting point of 800° C. was prepared according to the procedure of Example 1, by heating a crucible charged with a mixture of 90 wt. % zinc granules and 10 wt. % cobalt granules at 1200° C. under an argon atmosphere at a pressure of 900 KPa, for 30 minutes.

A corrosion potential measurement was carried out with a high impedance electrometer. The test was carried out in a 3% NaCl solution with a saturated calomel reference electrode and revealed a strong negative potential of −950 mV/ECS after stabilization. Such a potential confirms the propensity of the above zinc-cobalt alloy to form a galvanic cell providing an active cathodic protection to steel.

EXAMPLE 10

A zinc-iron alloy comprising 60 wt. % zinc and 40 wt. % iron and having a melting point of 1060° C. was prepared according to the procedure of Example 1, by heating a crucible charged with a mixture of 60 wt. % zinc granules and 40 wt. % iron granules at 1200° C. under an argon atmosphere at 900 KPa, for 30 minutes.

A corrosion potential measurement was carried out in the same conditions as in Example 9 and revealed a strong negative potential of −875 mV/ECS after stabilization. Such a potential confirms the propensity of the above zinc-iron alloy to form a galvanic cell providing an active cathodic protection to steel.

We claim:

1. A coating material exhibiting high corrosion resistance and adherence for forming corrosion-resistant thermal-sprayed coatings on metallic substrates, comprising a zinc-based alloy containing about 80 to 90 weight percent zinc and about 10 to 20 weight percent cobalt, said alloy being present in the form of particles having a size ranging from about 0.03 to about 0.15 mm.

2. A coating material exhibiting high corrosion resistance and adherence for forming corrosion-resistant thermal-sprayed coatings on metallic substrates, comprising a zinc-based alloy containing about 60 to 85 weight percent zinc and about 15 to 40 weight percent iron, said alloy being present in the form of particles having a size ranging from about 0.03 to about 0.1 mm.

3. A coating material exhibiting high corrosion resistance and adherence for forming corrosion-resistant thermal-sprayed coatings on metallic substrates, comprising a zinc-based alloy containing about 50 weight percent zinc and about 50 weight percent nickel, said alloy being present in the form of particles having a size ranging from about 0.03 to about 0.15 mm.

4. A method of forming a corrosion-resistant coating on a metallic substrate, which comprises applying by thermal spraying onto said metallic substrate a coating material exhibiting high corrosion resistance and adherence and comprising a zinc-based alloy containing about 50 to about 90 weight percent zinc and about 10 to 50 weight percent of at least one other metal selected from the group consisting of nickel, cobalt and iron, said alloy being present in said coating material in the form of particles having a size ranging from about 0.03 to about 0.15 mm.

5. A method as claimed in claim 4, wherein the coating material used comprises alloy particles having a size ranging from about 0.05 to about 0.12 mm.

6. A method as claimed in claim 4, wherein said alloy particles have a size ranging from about 0.04 to about 0.09 mm.

7. A method as claimed in claim 4, wherein said alloy particles have a size ranging from about 0.09 to about 0.15 mm.

8. A method as claimed in claim 4, wherein said coating material is applied onto said substrate by first generating a plasma and then admixing said coating material with said plasma to cause melting of the alloy particles and propelling of the molten alloy particles in a direction toward said substrate, and wherein said alloy particles have a residence time in said plasma which is controlled to cause melting of the alloy particles while preventing vaporization of zinc from the molten alloy particles.

9. A method as claimed in claim 8, wherein the plasma generated is a low-energy subsonic plasma and the residence time of the alloy particles in said plasma is about 0.5 ms.

10. A method as claimed in claim 8, wherein the molten alloy particles are allowed to travel a distance of about 6 to about 10 cm prior to impact on said substrate.

11. A method as claimed in claim 4, wherein said coating material is applied onto said substrate to form thereon a coating having a thickness of about 0.075 to about 0.5 mm.

12. A method as claimed in claim 4, wherein said coating material contains zinc-based alloy particles comprising about 50 to 75 weight percent zinc and about 25 to 50 weight percent nickel.

13. A method as claimed in claim 4, wherein said coating material contains zinc-based alloy particles comprising about 80 to about 90 weight percent zinc and about 10 to 20 weight percent cobalt.

14. A method as claimed in claim 4, wherein said coating material contains zinc-based alloy particles comprising about 60 to 85 weight percent zinc and about 15 to 40 weight percent iron.

15. A method as claimed in claim 4, wherein said coating material contains zinc-based alloy particles comprising 70 weight percent zinc and 30 weight percent nickel.

16. A method as claimed in claim 4, wherein said coating material contains zinc-based alloy particles comprising 50 weight percent zinc and 50 weight percent nickel.

17. A method as claimed in claim 4, wherein said coating material contains zinc-based alloy particles comprising 90 weight percent zinc and 10 weight percent cobalt.

18. A method as claimed in claim 4, wherein said coating material contains zinc-based alloy particles comprising 60 weight percent zinc and 40 weight percent iron.

* * * * *